US006845521B2

(12) United States Patent
Takeshi et al.

(10) Patent No.: US 6,845,521 B2
(45) Date of Patent: Jan. 25, 2005

(54) LENGTH ADJUSTING MECHANISM OF GOGGLES

(75) Inventors: Katsuya Takeshi, Osaka (JP); Keiko Nishida, Izumi (JP)

(73) Assignee: Yamamoto Kogaku Co., Ltd., Osaka (JP)

( * ) Notice: Subject to any disclaimer, the term of this patent is extended or adjusted under 35 U.S.C. 154(b) by 107 days.

(21) Appl. No.: 10/179,138

(22) Filed: Jun. 25, 2002

(65) Prior Publication Data

US 2002/0194669 A1 Dec. 26, 2002

(30) Foreign Application Priority Data

Jun. 26, 2001 (JP) ..... 2001-193237

(51) Int. Cl.[7] ..... A61F 9/02
(52) U.S. Cl. ..... 2/452
(58) Field of Search ..... 2/452, 427, 426, 2/440, 441, 442, 444, 445, 446; 351/43; 24/170, 191

(56) References Cited

U.S. PATENT DOCUMENTS

| | | | | | |
|---|---|---|---|---|---|
| 1,810,027 | A | * | 6/1931 | Moran et al. | 24/17 R |
| 3,606,648 | A | * | 9/1971 | Schuler | 24/16 PB |
| 4,912,779 | A | * | 4/1990 | Laird | 2/12 |
| 5,524,300 | A | * | 6/1996 | Chiang | 2/439 |
| 5,915,541 | A | * | 6/1999 | Beltrani | 2/430 |
| 5,956,778 | A | * | 9/1999 | Godoy | 2/428 |
| 6,446,272 | B1 | * | 9/2002 | Lee | 2/428 |

* cited by examiner

*Primary Examiner*—Katherine Moran
(74) *Attorney, Agent, or Firm*—Koda & Androlia

(57) ABSTRACT

The length adjusting mechanism includes an elastic headband member and an engaging member to engage with the headband member. The headband member is provided with a plurality of projected parts which selectively engage with the engaging member. The engaging member includes an insertion hole through which the headband member is inserted and one or more fiting grooves in which projected parts may just settle selectively. At the time of putting the goggles on, a wearer may easily adjust the length with less force than for conventional goggles.

6 Claims, 10 Drawing Sheets

LENGTH ADJUSTING MECHANISM OF GOGGLES

FIELD OF THE INVENTION

The present invention relates to a length adjusting mechanism used in goggles such as swimming goggles or the like.

PRIOR ART

In swimming, swimming goggles for protecting a wearer's eyes have been regularly and widely used.

One example of goggles of this type is illustrated in FIG. 10. The swimming goggles have an elastic headband 11 and a length adjusting mechanism 12 for the purpose of giving a comfortable fitting to a wearer. Such a mechanism is provided because too loose fitting causes water intrusion inside lenses 13 and too tight fitting gives a wearer uncomfortableness of being pressed, so individual adjustment is necessary.

In use, the length of the headband 11 is roughly adjusted beforehand, and a wearer has the goggles on his or her head. If the wearer feels the headband 11 too tight or too loose, then he or she takes goggles off and re-adjusts the length.

Practically, the headband 11 is made of elastic rubber, longitudinally folded back, and engages in a two-ply fashion with the length adjusting mechanism 12. And in order to reliably keep the length in use, the length adjusting mechanism 12 of the headband 11 is usually designed to relatively firmly fix the length by friction force between the plies of the rubber. Therefore it is not easy to re-adjust the length but requires rather large force of thumbs and fingers.

It is, therefore, an object of the present invention to overcome the problems present in the above mentioned length adjusting mechanism. More specifically, it is an object of the present invention to provide a length adjusting mechanism used in goggles which readily functions and requires less manual force for adjusting than the conventional one does.

THE SUMMARY OF THE INVENTION

A length adjusting mechanism according to the present invention includes an elastic headband member and an engaging member for engaging with the headband member. The headband member includes a plurality of projected parts which selectively engage with the engaging member. The engaging member is provided with an insertion hole to receive the headband member and a fitting groove to receive a selected projected part of the headband member.

Since the length adjusting mechanism of the headband member of goggles is provided with the insertion hole and the fitting groove, at the time of adjusting the length, the headband member may be manipulated in a removal direction where the projected parts of the headband member inserted through the insertion hole of the engaging member removes from the fitting groove, so that the fixed engagement is released and the headband member may be shifted.

Also, the selected projected part of the inserted headband member is fitted in the fitting groove of the engaging member, and the headband member would not be off from the fixed position in use.

The headband member may be inserted outwardly through the insertion hole of the engaging member. This allows the headband member to come out from the insertion hole of the engaging member outwardly, so that the length is easily adjusted while the goggles are put on a wearer's head.

A pair of goggles may be formed with the foregoing length adjusting mechanism and lens members. The engaging member of the length adjusting mechanism of goggles may be either formed separately from or integrally with an lens-cap of the lens member.

The above and other objects, features and advantages of the present invention will become apparent from the following description read in conjunction with the accompanying drawings, in which like reference numbers designate the same elements.

DETAILED DESCRIPTION OF THE INVENTION (Embodiment 1)

Figure 1:
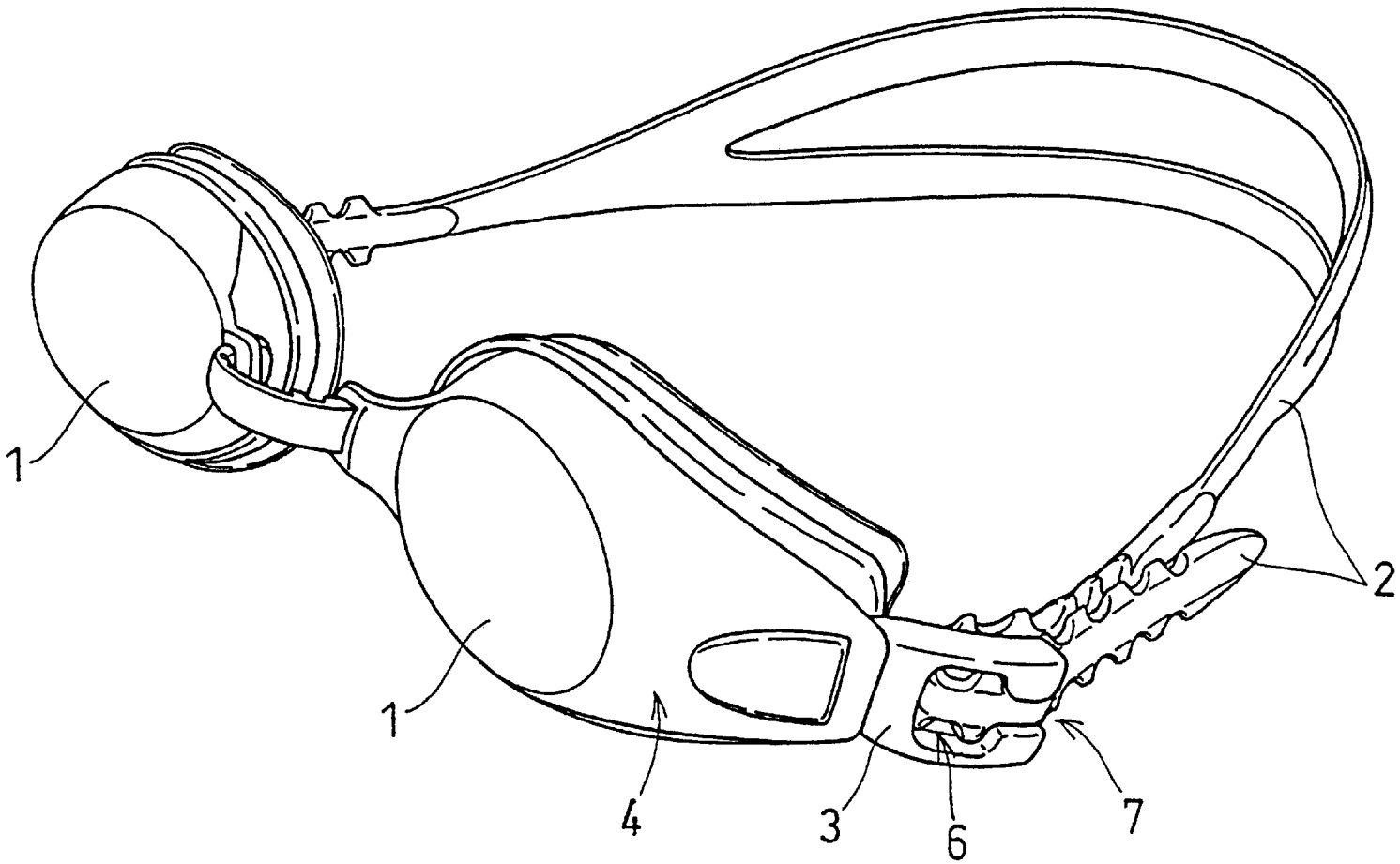
FIG. 1 is a perspective view showing the entire goggles with a length adjusting mechanism according to a first embodiment of the present invention.
Figure 2:
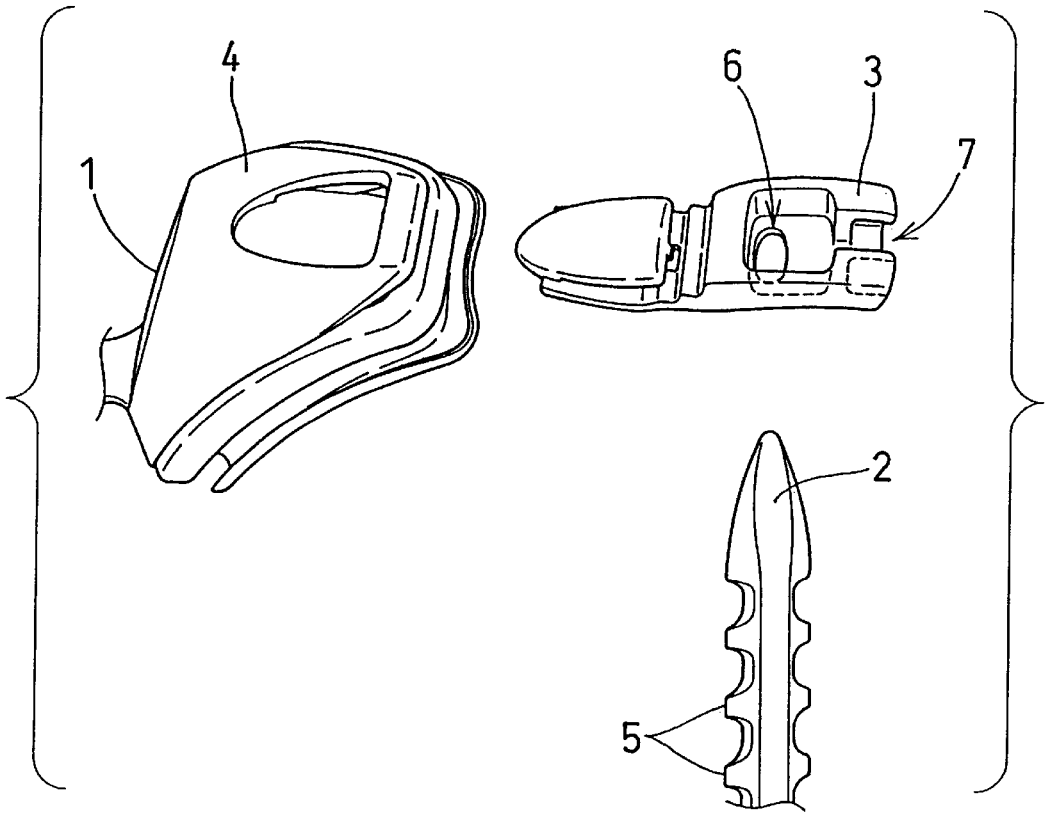
FIG. 2 is an exploded perspective view showing the length adjusting mechanism of the goggles in FIG. 1.
Figure 3:
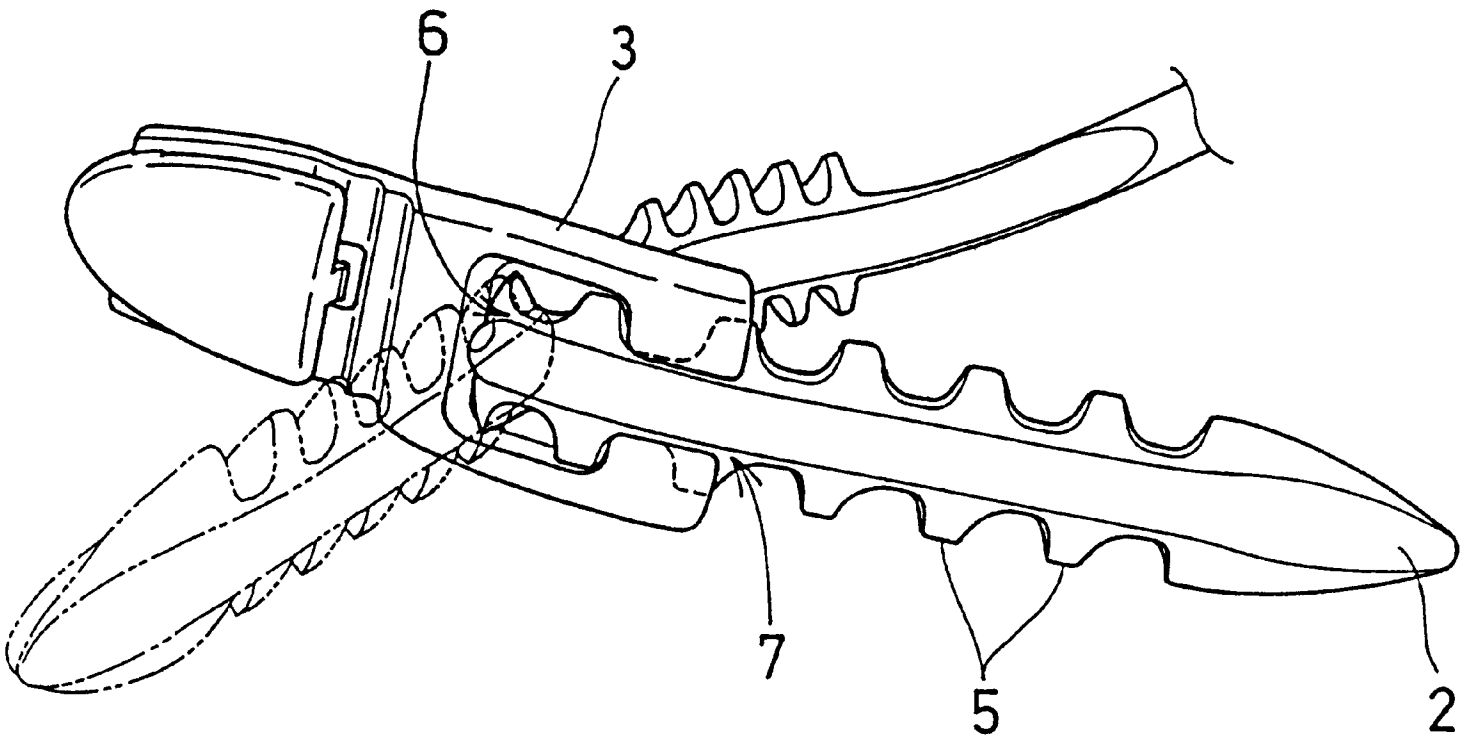
FIG. 3 is a perspective view showing how to use the length adjusting mechanism of the goggles in FIG. 1.

FIGS. 1 to 3 show a first embodiment. Goggles here is swimming goggles with a headband member. The goggles have lens members 1 at a right and a left side and a headband member 2 connected with the lateral ends of the lens members (a right end of the right lens member and a left end of the left lens member) to form a loop as a whole.

A length adjusting mechanism of goggles includes the headband member 2 which has rubber elasticity and one engaging member 3 at the end of one of the lens members 1 or two engaging members 3 at the ends of the lens members 1 to engage the headband member 2. One engaging member 3 may be preferably formed either separately from a lens cap 4 of the lens member 1 (the engaging member 3 gets into the lens cap 4) or integrally with the lens cap 4.

The headband member 2 is provided with a plurality of projected parts 5 at about same intervals and in about same size on an area in the longitudinal direction which engages the engaging member 3. As seen particularly from FIG. 3, the parts 5 may be formed by giving projections from both of the edges of the headband member 2. The parts 5 may otherwise be formed by providing cutouts in opposing edge parts of the headband member 2. The area of the headband member 2 on which the projected parts 5 are provided is formed like a configuration of fish bones, saw teeth, a centipede or prayer beads.

The engaging member 3 is provided with an insertion hole 6 through which the headband member 2 is inserted and a fitting groove 7 to receive the projected parts 5 of the headband member 2.

The headband member 2 is inserted through the insertion hole 6 of the engaging member 3 outwardly so that the end of the headband member 2 is exposed outside. The engaging member 3 is inclined outwardly by 0 degree or more than a regular shape so that the headband member 2 would less easily touch with the face of a wearer.

The fitting groove 7 is formed in a configuration into which one of projected parts may just be stuck, and at a position a certain distance away from the insertion hole 6. The shape of one of the projected parts 5 of the headband member 2 is made so as to be readily released from the fitting groove 7 with an easy manipulation. The engaging member 3 is formed three-dimensionally and the projected part 5 of the headband member 2 is held within the fitting groove 7. As a result, the projected part 5 of the headband member 2 and the fitting groove 7 are favorably engaged with each other.

How to use the length adjusting mechanism of the goggles according to the first embodiment is described below.

As shown in FIG. 3, when fitting the headband member 2 with the engaging member 3, the headband member 2 is inserted through the insertion hole 6 of the engaging member 3. While the headband member 2 being pulled, the projected parts are also drawn through the insertion hole 6 until one of them is put in the fitting groove 7. Then, the headband member 2 is reliably fixed with the fitting groove 7.

The length adjusting mechanism of goggles includes, on the engaging member 3, the insertion hole 6 through which the headband member 2 is inserted and the fitting groove 7 in which the projected parts 5 are selectively received. Therefore, at the time of adjusting the length, the headband member 2 is manipulated in a removal direction where the projected parts 5 of the headband member 2 inserted through the insertion hole 6 of the engaging member 3 come out from the fitting groove 7 where the parts 5 have been in. So that the engagement between the projected parts 5 and the fitting groove 7 becomes off and the fixed state is released and the headband member 2 may be off from the position where it has been.

The headband member 2 may be shifted gradually by engaging any of the projected parts 5 one by one with the fitting groove 7 and locked at any preferable position. Therefore as large force as a conventional length adjusting mechanism requires may not be needed in manipulation of the mechanism according to the present invention. And children or elderly persons who have rather a small finger force also may easily adjust the length of the headband member.

The length adjusting mechanism according to the present invention enables to easily adjust the length and maintain a reliable holding feeling of a wearer without fixing the headband member 2 tightly, so a very useful and handy mechanism may be provided. Furthermore, the goggles may be put on the head of a wearer with comfortable tightness and used with improved fitness, and further provide with a favorable and maintainable sealed state inside the lenses.

In addition, the projected part 5 of the inserted headband member 2 is fitted in the fitting groove 7 of the engaging member 3 to be in a lock state, and thereby the headband member 2 would not be shifted in use.

Furthermore, the headband member 2 is to be inserted through the insertion hole 6 of the engaging member 3 outwardly (here "inward" means the side to a face of a wearer). Therefore the headband member 2 comes out outwardly through the insertion hole 6 of the engaging member 3, which advantageously facilitates easy adjusting of the length of the headband member 2 while the goggles are being on a head of a wearer.

(Embodiment 2)

Figure 4:
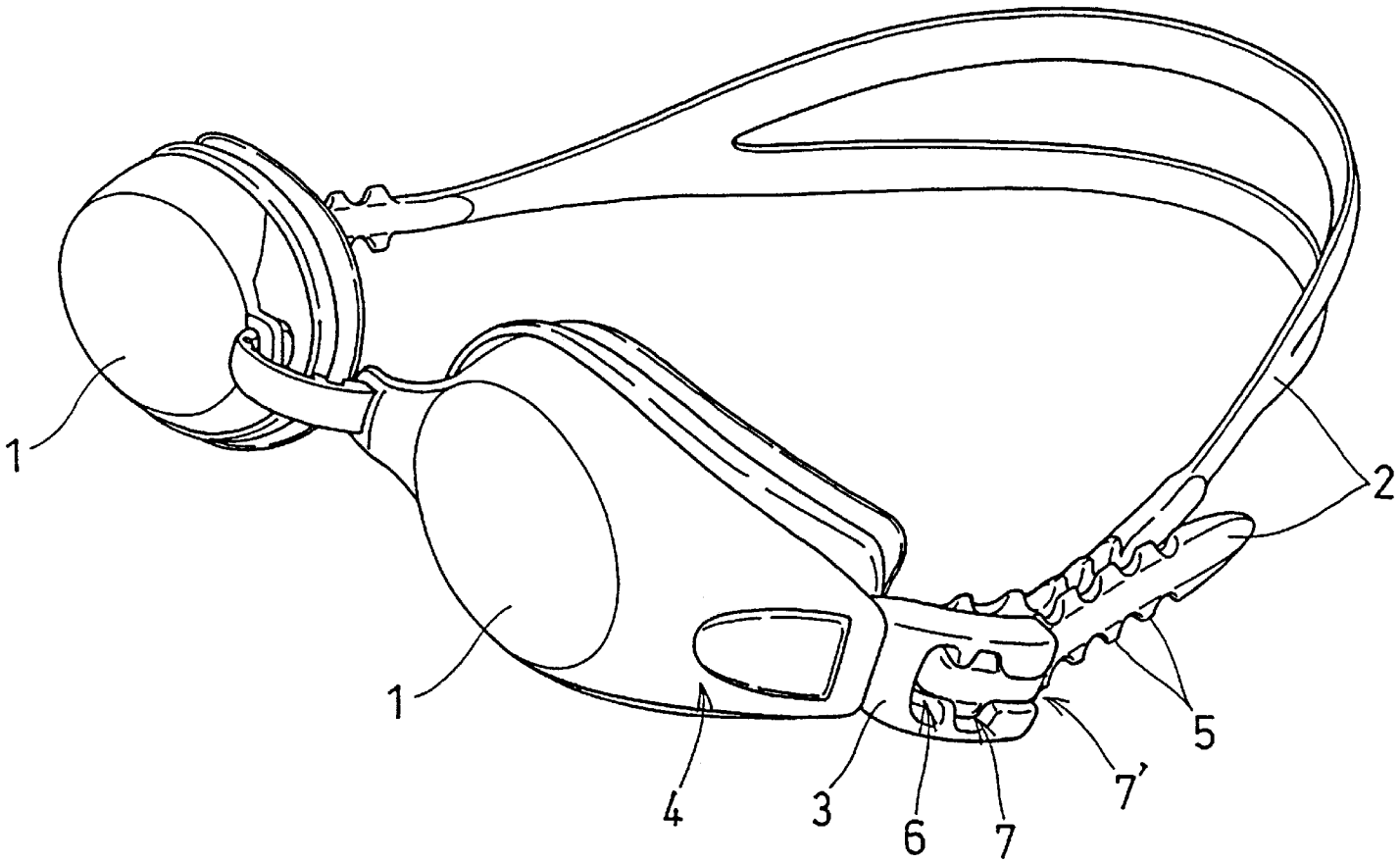
FIG. 4 is a perspective view showing the entire goggles with a length adjusting mechanism according to a second embodiment of the present invention.
Figure 5:
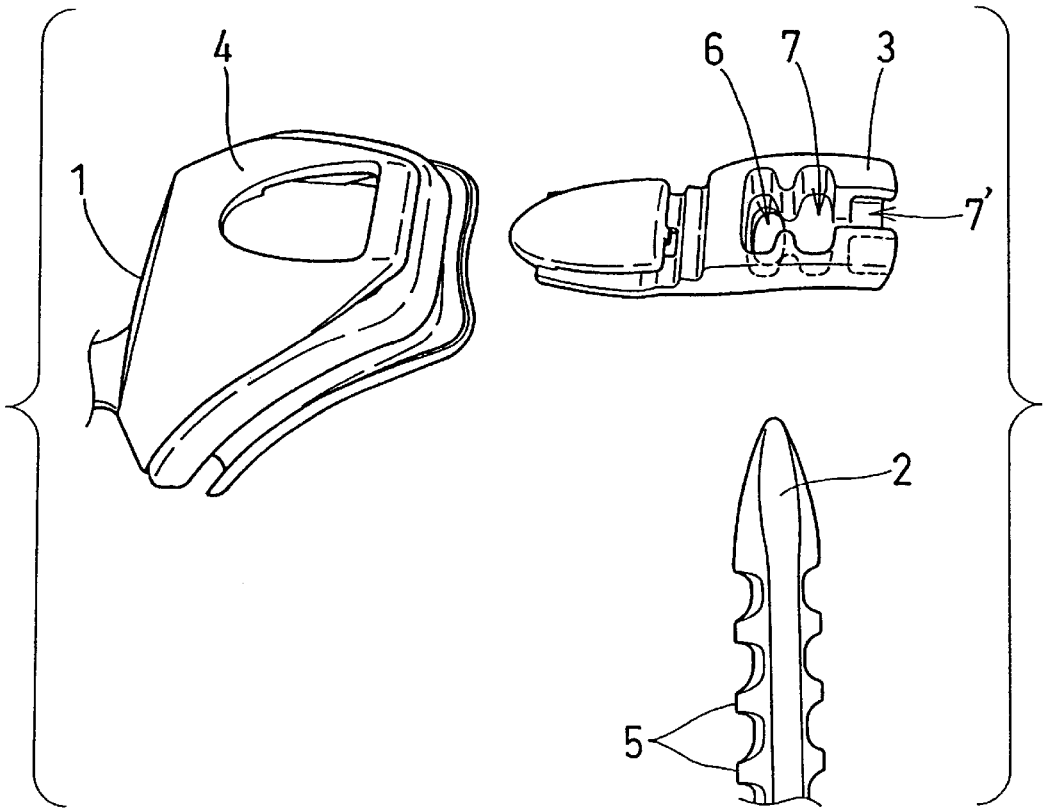
FIG. 5 is an exploded perspective view showing the length adjusting mechanism of the goggles in FIG. 4.
Figure 6:
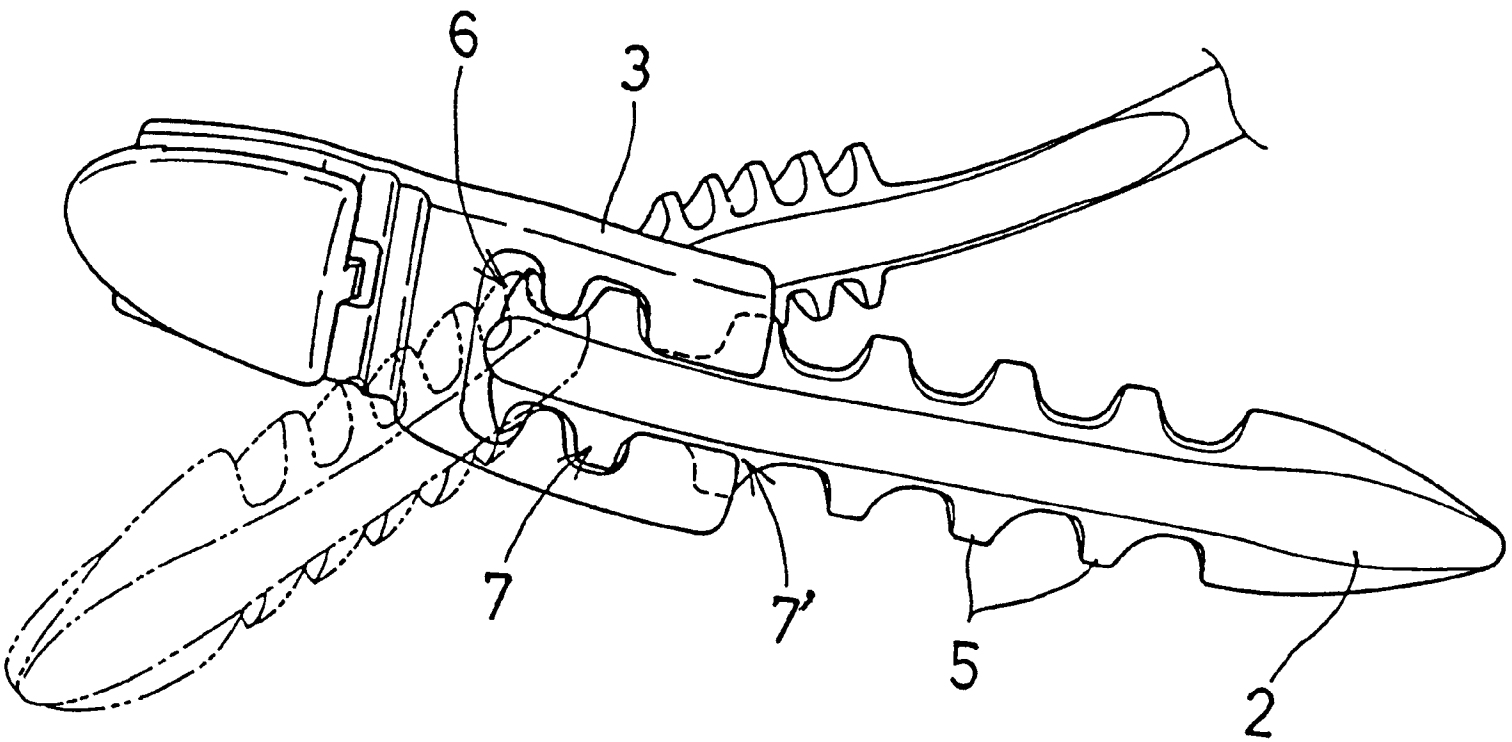
FIG. 6 is a perspective view showing how to use the length adjusting mechanism of the goggles in FIG. 4.

FIGS. 4 to 6 show a second embodiment. Goggles here is swimming goggles with a headband member 2. The goggles have lens members 1 at a right and a left side and a headband member 2 connected with the lateral ends of the lens members (a right end of the right lens member and a left end of the left lens member) to form a loop as a whole.

A length adjusting mechanism of goggles includes the headband member 2 which has rubber elasticity and one engaging member 3 at the end of the one of the lens members 1 to engage the headband member 2. Two engaging members 3 may be provided at the both ends of the lens members 1 (here both of the ends of headband member 2 engage with respective engaging members 3). One engaging member 3 may be preferably either separately from a lens cap 4 of the lens member 1 (the engaging member 3 gets into the lens cap 4) or integrally with the lens cap 4.

The headband member 2 is provided with a plurality of projected parts 5 at about same intervals and in about same size on an area in the longitudinal direction which engages the engaging member 3. As seen particularly from FIG. 6, the parts 5 may be formed by giving projections from both the edges of the headband member 2. The parts 5 may otherwise be formed by providing cutouts in opposing edge parts of the headband member 2. The area of the headband member 2 on which the projected parts 5 are provided is formed like a configuration of fish bones, saw teeth, a centipede or prayer beads.

The engaging member 3 is provided with an insertion hole 6 through which the headband member 2 is inserted and fitting grooves 7 and 7' to receive the projected parts 5 of the headband member 2.

The headband member 2 is outwardly inserted through the insertion hole 6 of the engaging member 3 so that the end of the headband member 2 is exposed outside. The engaging member 3 is inclined outwardly by 0° or more so that the headband member 2 would less easily touch the face of a wearer.

The fitting grooves 7 and 7' are formed in a shape which the projected parts 5 may just settle in and be disposed at a certain distance from each other. The shape of one of the projected parts 5 of the headband member 2 is made so as to be readily released from to fitting groove 7' with an easy manipulation. The engaging member 3 is formed three-dimensionally and the projected parts 5 of the headband member 2 are held within the fitting grooves 7 and 7'. As a result, the projected parts 5 of the headband member 2 and the fitting grooves 7 and 7' are favorably engaged with each other.

How to use the length adjusting mechanism of the goggles according to this second embodiment is described below.

As shown in FIG. 6, when fitting the headband member 2 with the engaging member 3, the headband member 2 is inserted through the insertion hole 6 of the engaging member 3. While the headband member 2 being pulled, the projected parts are also drawn through the insertion hole 6 and the selected projected parts are in sequence put in the fitting grooves 7 and 7'. The headband member 2 is fixed with the projected parts at a position of the front side fitting groove 7 and further fixed perfectly with the next projected parts at a position of the rear side fitting groove 7'.

This length adjusting mechanism of goggles includes, on the engaging member 3, the insertion hole 6 through which the headband member 2 is inserted and the fitting grooves 7 and 7' in which the projected parts 5 may settle selectively. Therefore, at the time of adjusting the length, when the headband member 2 inserted through the insertion hole 6 of the engaging member 3 is manipulated in a removal direction in which the projected parts 5 of the headband member 2 come off from the fitting grooves 7 and 7', the projected parts 5 come out from the position they have settled, the engagement between the projected parts 5 and the fitting grooves 7 and 7' becomes off and the fixed state is released and the headband member 2 may be off from the position where it has settled.

The headband member 2 may be shifted gradually by engaging any of the projected parts 5 one by one with the fitting grooves 7 and 7' and locked at any preferable position. Therefore, as large of a force as a known mechanism requires may not be needed in manipulation. And children or elderly persons who generally have less finger strength also may easily adjust the length of the headband member.

The length adjusting mechanism according to the present invention enables a wearer to easily adjust the length and maintain a reliable holding feeling of a wearer without fixing the headband member 2 tightly, so a very useful and handy mechanism may be provided. Furthermore, the goggles may be put on the head of a wearer with conformable tightness and used with improved fitness, and further provide with a favorable and maintainable sealed state inside the lenses.

In addition, the projected parts 5 of the inserted headband member 2 is fitted in the fitting grooves 7 and 7' of the engaging member 3 to be in a locked state, and thereby the headband member 2 would not be shifted in use.

Furthermore, the headband member 2 is to be inserted through the insertion hole 6 of the engaging member 3 outwardly (here "inward" means the side to a face of a wearer). Therefore the headband member 2 comes out outwardly through the insertion hole 6 of the engaging member 3, which advantageously facilitates easy adjusting of the length of the headband member 2 while the goggles are kept on a head of a wearer.

(Embodiment 3)

Figure 7:
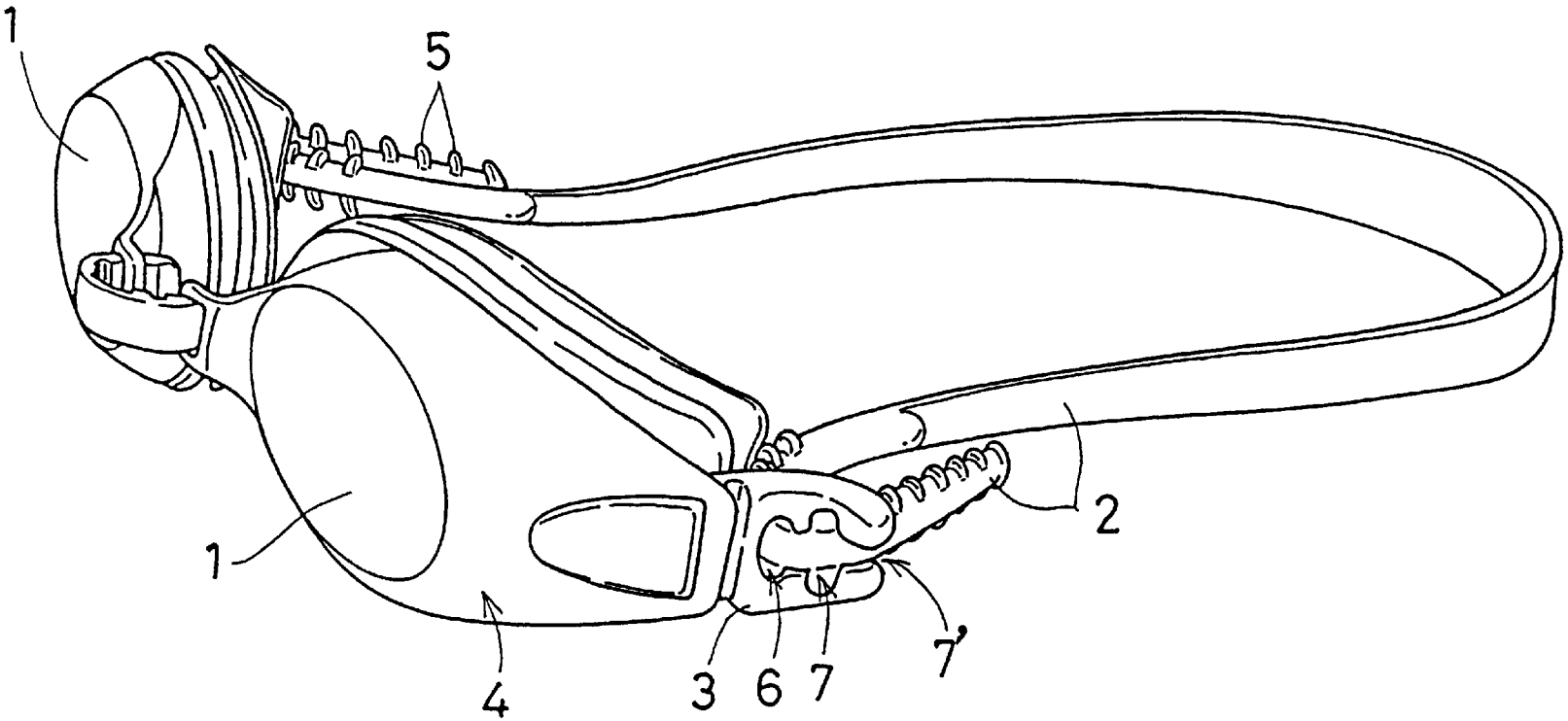
FIG. 7 is a perspective view showing the entire goggles with a length adjusting mechanism according to a third embodiment of the present invention.
Figure 8:
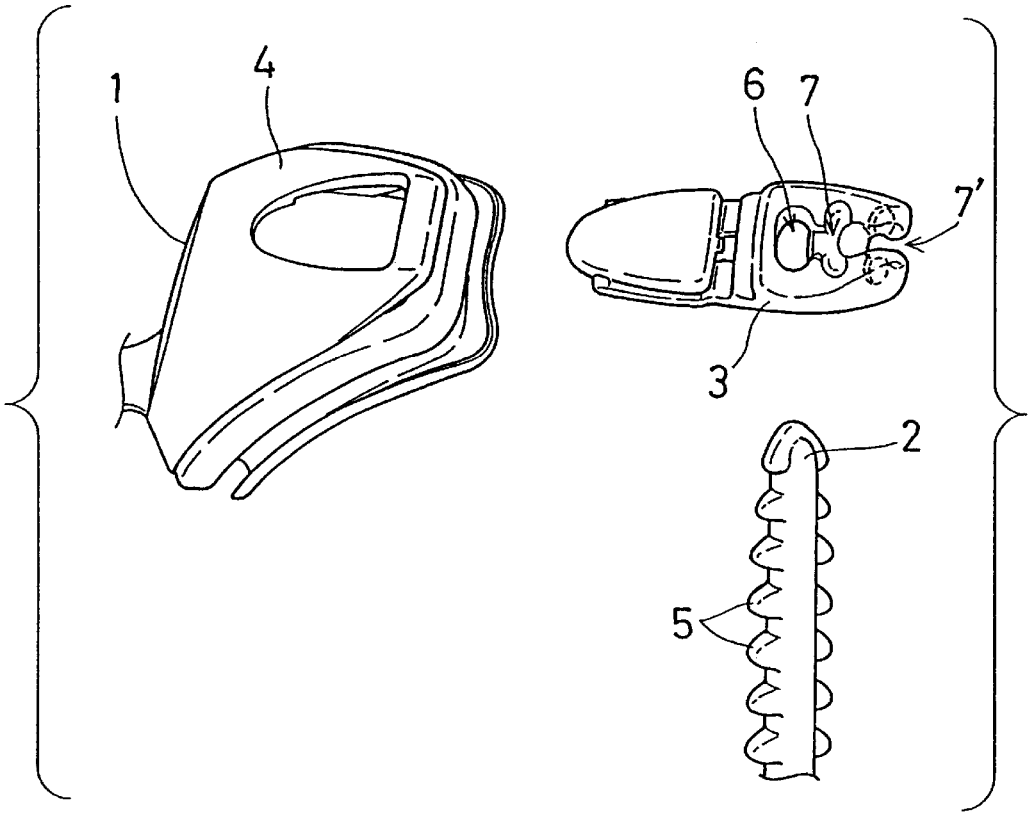
FIG. 8 is an exploded perspective view showing the length adjusting mechanism of the goggles in FIG. 7.
Figure 9:
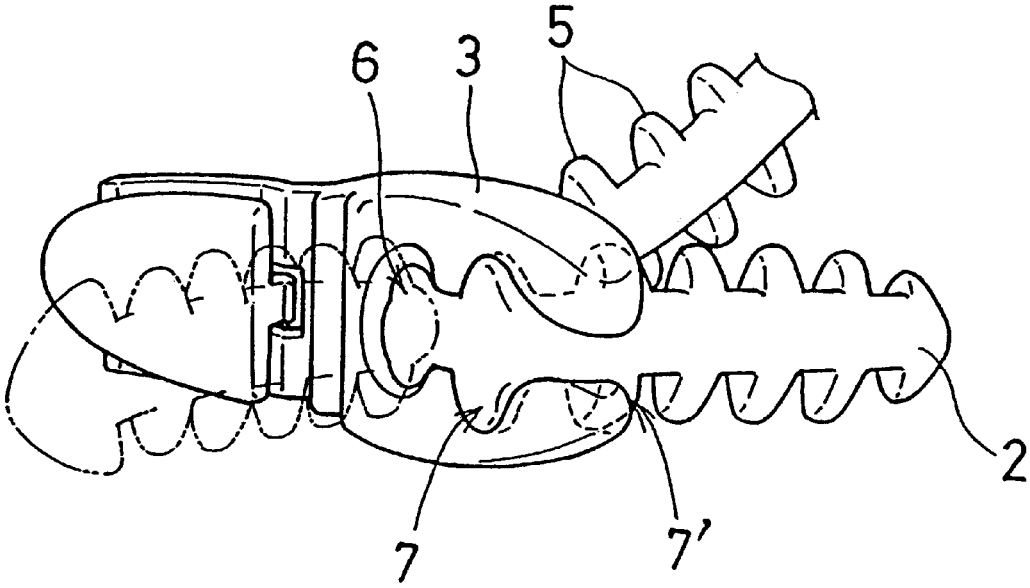
FIG. 9 is a perspective view showing how to use the length adjusting mechanism of the goggles in FIG. 7.
Figure 10:
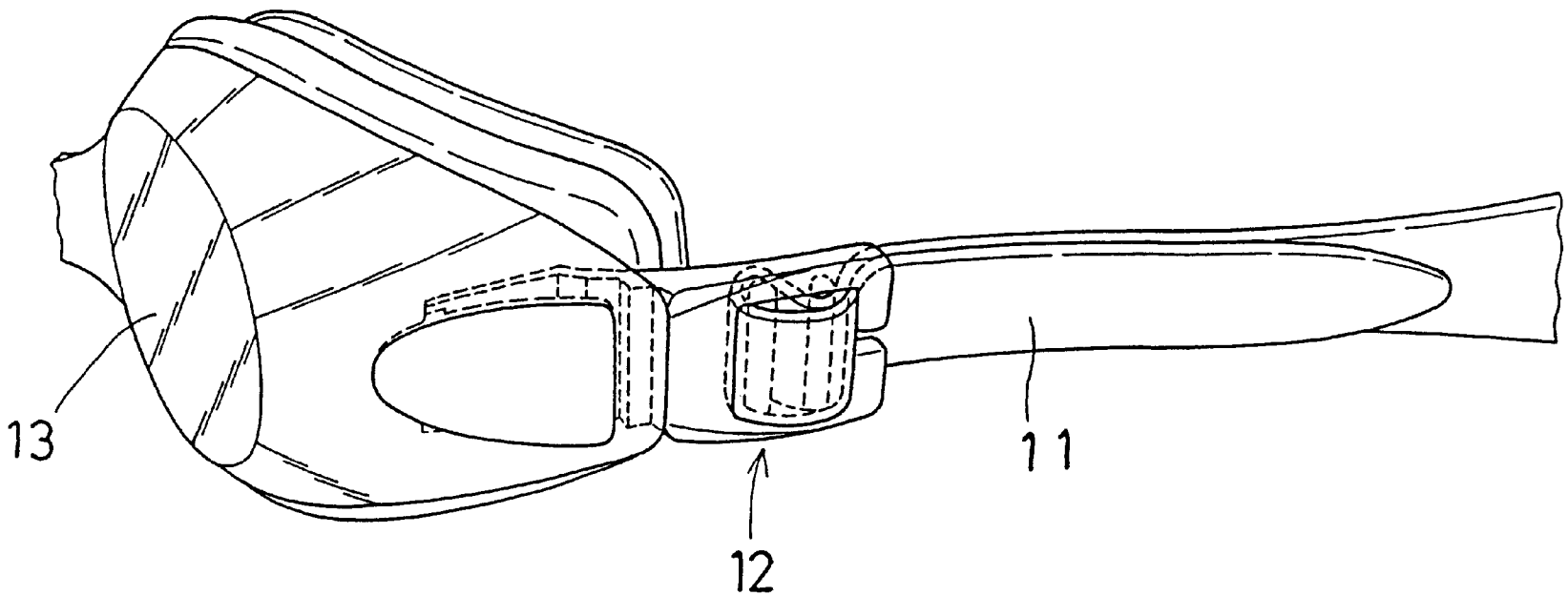
FIG. 10 Prior Art
FIG. 10 is a perspective view showing a known length adjusting mechanism of goggles.

A third embodiment is illustrated in FIGS. 7 to 9. This embodiment is described below referring to the differences from the foregoing embodiments.

The engaging member 3 has fitting grooves 7 and 7', which are rather shallow so that the projected parts 5 of the headband member 2 could surface a bit. Therefore, the projected parts 5 of the headband member 2 may be more readily removed from the fitting grooves 7 and 7'. The parts 5 of this embodiment may also be formed on the headband member 2 in the same way that for the first and the second embodiments.

Being constructed as stated above, the present invention has advantages. At the time of adjusting the length, when the headband member 2 inserted through the insertion hole 6 of the engaging member 5 is manipulated in a removal direction in which the projected parts 5 comes off from the fitting grooves 7 and/or 7' where they have been in, the engagement between the projected parts 5 and the fitting grooves 7 and/or 7' becomes off and the fixed state is released and the headband member 2 may be off from the position where it has been. Therefore, at the time of wearing goggles on, the length adjusting mechanism requires less force to adjust the length than the conventional one does.

What is claimed is:

1. A length adjustment mechanism for goggles, wherein the length adjusting mechanism comprises an elastic headband member, and at least a single engaging member which engages with the elastic headband member, wherein the headband member has peripheral edges, with a portion of the headband member having a plurality of spaced indentations forming projected parts along said peripheral edges, and said engaging member is provided with an insertion hole through which the headband member is inserted and a fitting groove within which the projected parts are selectively received upon inserting and folding back said headband member, wherein said headband member is adjusted by selective engagement with said engaging member.

2. The length adjusting mechanism of goggles according to claim 1, wherein the headband member is inserted though the insertion hole outwardly.

3. Goggles including a length adjusting mechanism, wherein the length adjusting mechanism comprises an elastic headband member, and at least a single engaging member which engages with the elastic headband member, wherein the headband member has peripheral edges, with a portion of the headband member having a plurality of spaced indentations forming projected parts along said peripheral edges, and said engaging member is provided with an insertion hole through which the headband member is inserted and a fitting groove within which the projected parts are selectively received upon inserting and folding back said headband member, wherein said headband member is adjusted by selective engagement with said engaging member.

4. The goggles according to claim 3, wherein the headband member is inserted through the insertion hole outwardly.

5. Goggles according to claim 4 further comprises a lens member.

6. Goggles according to claim 3 further comprising a lens member.

* * * * *